US006752658B2

(12) United States Patent
Jones

(10) Patent No.: US 6,752,658 B2
(45) Date of Patent: Jun. 22, 2004

(54) LOW CROSSTALK INSULATION DISPLACEMENT CONNECTOR FOR TERMINATING CABLE TO CIRCUIT BOARD

(75) Inventor: Dennis B. Jones, Orange, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/243,422

(22) Filed: Sep. 12, 2002

(65) Prior Publication Data

US 2004/0053532 A1 Mar. 18, 2004

(51) Int. Cl.[7] ..... H01R 9/05

(52) U.S. Cl. ..... 439/581; 439/79; 439/101; 439/404

(58) Field of Search ..... 439/581, 63, 79, 439/80, 387, 391, 395, 404, 406, 497, 101

(56) References Cited

U.S. PATENT DOCUMENTS 3,808,582 A * 4/1974 Aldridge et al. ..... 439/395
3,963,319 A * 6/1976 Schumacher et al. ..... 439/439
4,605,269 A * 8/1986 Cohen et al. ..... 439/63
5,188,536 A * 2/1993 Ganthier et al. ..... 439/83
5,551,889 A * 9/1996 Kozel et al. ..... 439/404
6,093,048 A * 7/2000 Arnett et al. ..... 439/404
6,379,198 B1 * 4/2002 Arnett et al. ..... 439/825

* cited by examiner

*Primary Examiner*—Tulsidas Patel
(74) *Attorney, Agent, or Firm*—Wei Te Chung

(57) ABSTRACT

An electrical connector (1) mounted to a PCB (3) comprises a bottom housing (4), an upper housing (5) assembled to the bottom housing, a cable (2), a plurality of signal terminals (6) and grounding terminals (7, 8) therein. The bottom housing has a first groove (42) and a plurality of recesses (402). The upper housing has a second groove (52) and a plurality of depressing blocks (500) being respectively aligned with the first groove and the recesses. The cable extends through a cable-receiving groove defined by the first groove and the second groove and has a plurality of wires (20) extended into corresponding recesses at which the depressing blocks apply pressure to the wires for securing the wires in corresponding recesses. Each signal terminal comprises a retention portion (64) disposed in a corresponding recess of the bottom housing and electrically engaging a corresponding wire by insulation displacement connection (IDC), and a tail portion (62) surface mounted to the PCB.

18 Claims, 8 Drawing Sheets

LOW CROSSTALK INSULATION DISPLACEMENT CONNECTOR FOR TERMINATING CABLE TO CIRCUIT BOARD

BACKGROUND OF THE INVENTION

1. Field of the Invention

The present invention relates to the art of an electrical connector, and particularly to an electrical connector having insulation displacement connection (IDC hereinafter) terminals which connect a round cable to a printed circuit board.

2. Description of Related Art

It is well known that crosstalk in signal transmission, specially in high speed signal transmission, will deteriorate the quality of the signal. Where an electrical connector having a plurality of electrical terminals connects a cable to a printed circuit board (PCB hereinafter), it is generally desired to provide a mechanism for decreasing the occurrence of crosstalk. In addition, the electrical connector should have a simple structure so that it can have a low cost to meet market competitiveness.

U.S. Pat. No. 5,057,032 discloses that a board edge connector rotatable between a first position to a second position thereby electrically connecting a cable to a circuit board. The electrical connector comprises a housing means to receive leading edge of the board at a preselected angle. However, this connection causes the engagement between the connector and the circuit board to be not reliable, whereby a secure engagement between the cable and the circuit board cannot be assured.

U.S. Pat. No. 5,234,353 discloses that an assembly of matable connectors including first and second electrical connectors connects a cable to a circuit board, wherein the first connector has board mountable terminals therein and the second connector has cable-engaging terminals engaging with the board mountable terminals by a press force. However, this type of design needs a pair of connectors, which has a complicated structure and a high cost.

U.S. Pat. Nos. 5,551,889, 6,050,845, 6,093,048 and 6,379,198 each disclose that a wire to board connector has a block including cavities and contacts and a cable cover provided for receiving wires therein. However, these designs cannot be used for high speed signal transmission, due to not having ground contacts between signal contacts.

Hence, an improvement to resolve the problems of the prior art is required.

SUMMARY OF THE INVENTION

Accordingly, an object of the present invention is to provide an electrical connector which can be simply and securely mounted to a surface of a PCB.

Another object of the present invention is to provide an electrical connector which has grounding terminals to improve signal transmission performance.

A further object of the present invention is to provide an electrical connector connecting a cable to a PCB, wherein the connector has a simple structure so that its cost can be lowered.

In order to achieve the objects set forth, an electrical connector mounted to a printed circuit board in accordance with the present invention, comprises a first housing, a second housing assembled to the first housing, a cable, and a plurality of signal terminals and grounding terminals therein. The first housing has a first groove and a plurality of recesses. The second housing has a second groove and a plurality of depressing blocks for being respectively aligned with the first groove and the recesses. The cable extends through a cable-receiving groove defined by the first and second grooves. The cable has a plurality of wires extended into the recesses at which the depressing blocks apply pressure to the wires for securing the wires in corresponding recesses. Each signal terminal comprises a retention portion disposed in a corresponding recess of the first housing and electrically engaging a corresponding wire by insulation displacement connection (IDC), a body portion engaging with the first housing, and a tail portion for soldering to the printed circuit board.

Other objects, advantages and novel features of the invention will become more apparent from the following detailed description when taken in conjunction with the accompanying drawings.

DETAILED DESCRIPTION OF THE INVENTION

Figure 1:
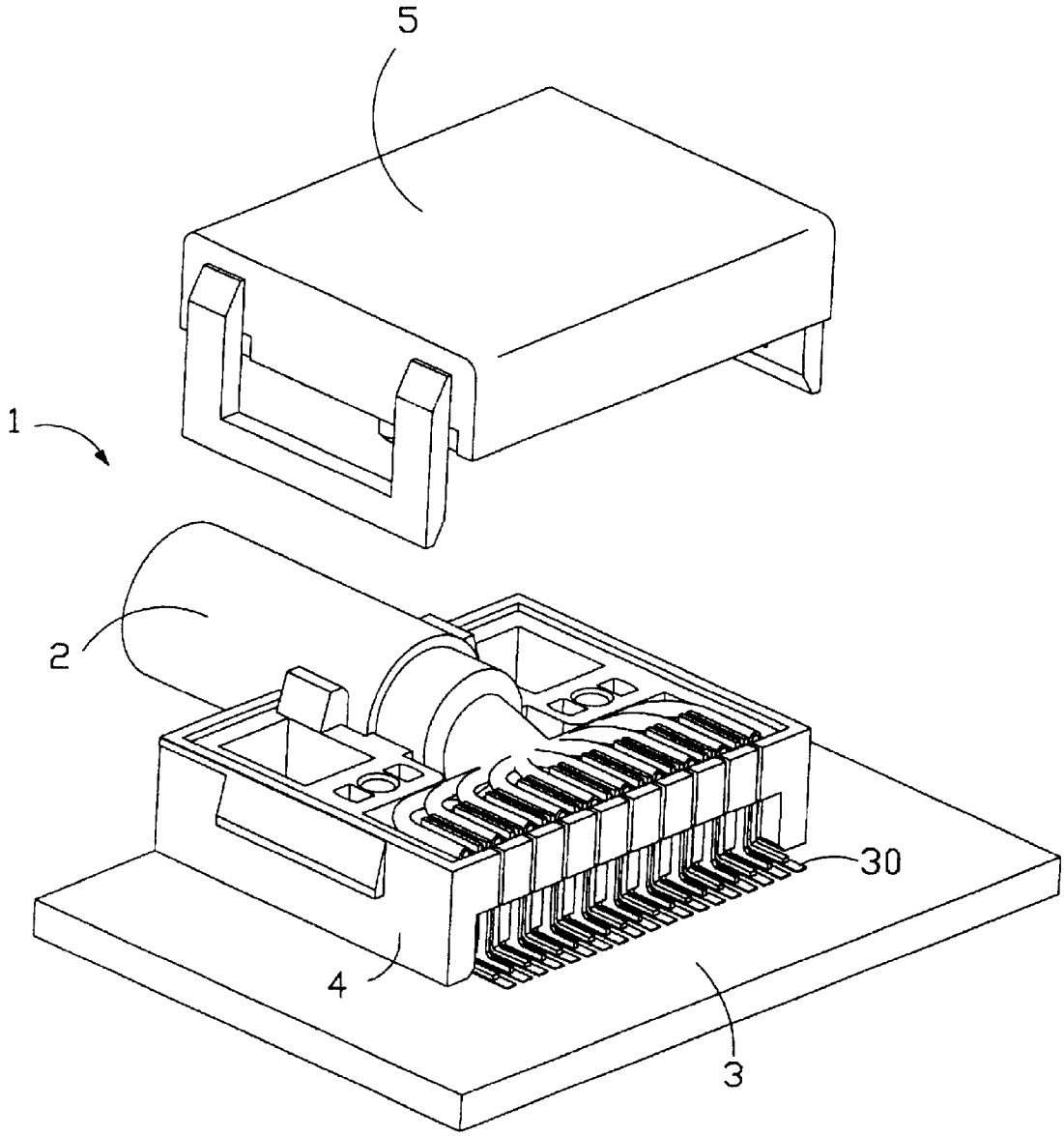
FIG. 1 is a perspective view of an electrical connector in accordance with the present invention mounted to a PCB, with an upper housing being separated from the connector.
Figure 2:
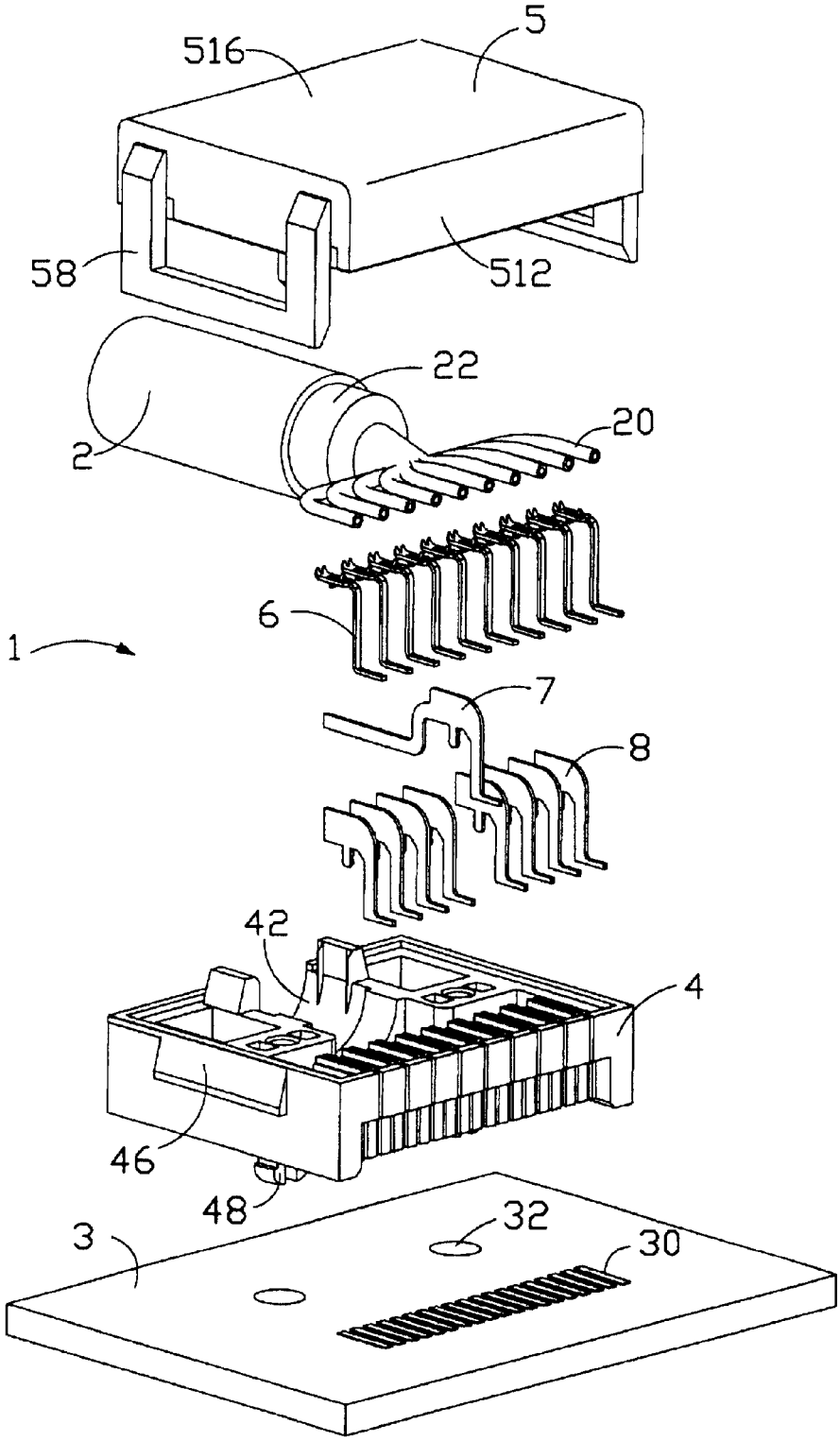
FIG. 2 is an exploded view of FIG. 1.

Referring first to FIGS. 1 and 2, an electrical connector 1 in accordance with the present invention includes a bottom housing 4, an upper housing 5, a round cable 2 disposed between the upper and bottom housing 4, 5, and a plurality of signal terminals 6 and first and second grounding terminals 7, 8. The electrical connector 1 is mounted to a PCB 3 which has a row of solder pads 30 thereon and a pair of through holes 32 therein. The cable 2 has a plurality of wires 20 and a metal shield 22 surrounding the wires 20.

Figure 3:
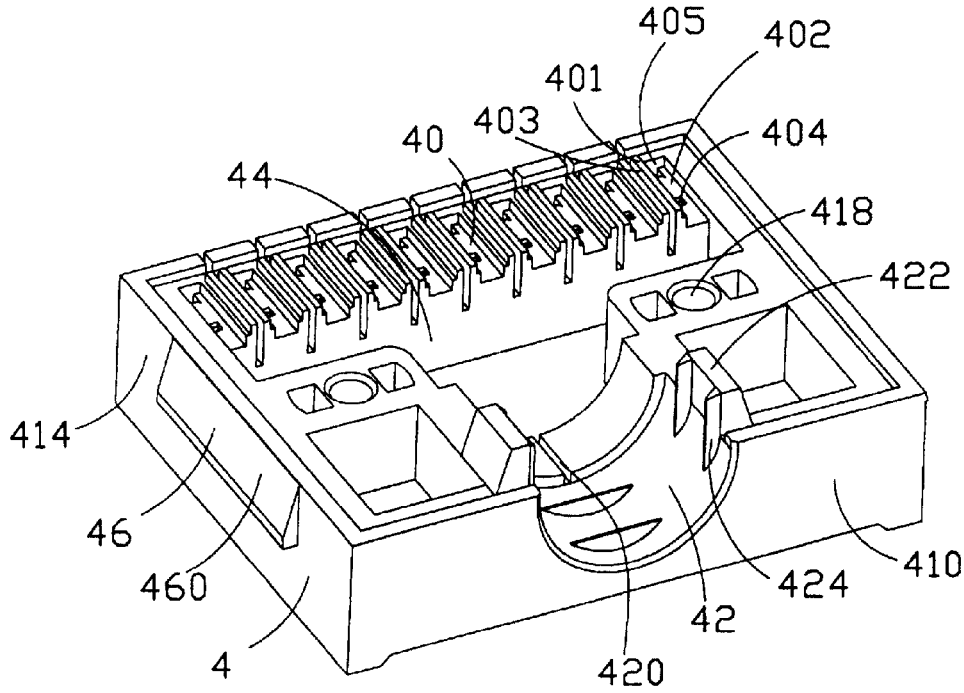
FIG. 3 is a top perspective view of a bottom housing of the electrical connector.
Figure 4:
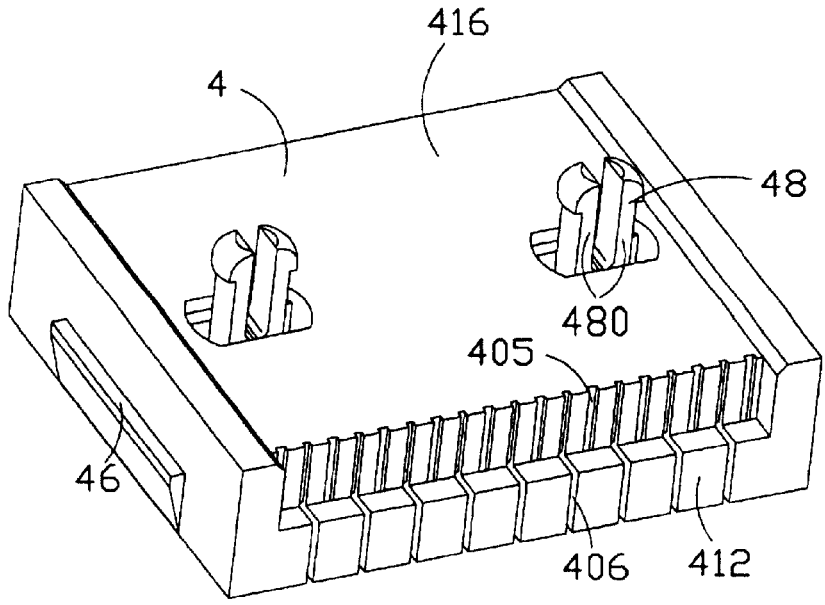
FIG. 4 is a bottom perspective view of the bottom housing of the electrical connector.
Figure 9:
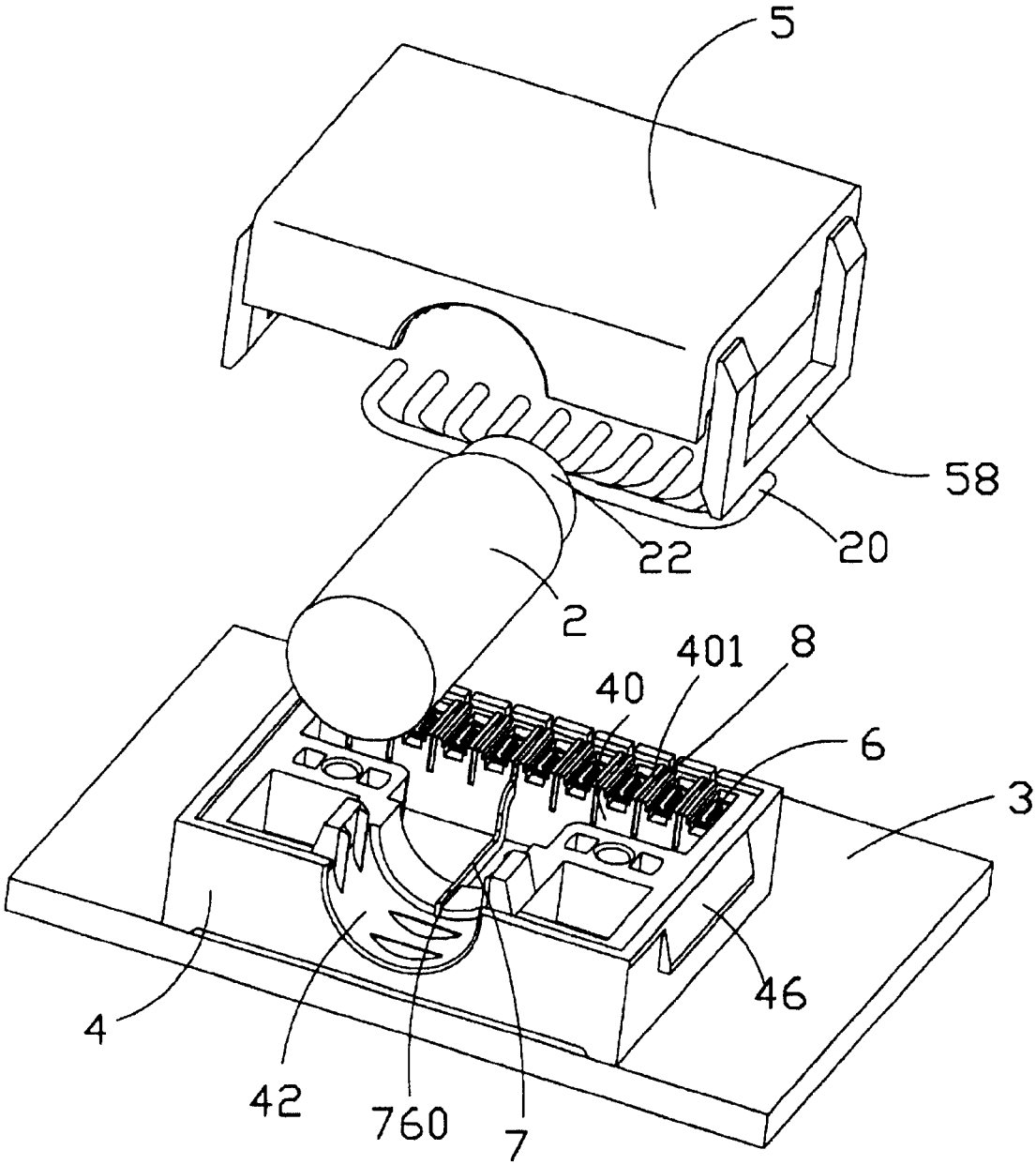
FIG. 9 is a perspective view of the electrical connector for showing mounting of the first grounding terminal in the bottom housing of the electrical connector.

Referring now to FIGS. 3 and 4, the bottom housing 4 has a cable-receiving surface 410, a terminal surface 412 opposite to the cable-receiving surface 410, a pair of lateral surfaces 414 and a board mounting surface 416. The bottom housing 4 includes a forward portion 40 near the terminal surface 412, a first groove 42 horizontally extending inwardly from the cable-receiving surface 410 towards the terminal surface 412, a first cavity 44 defined between the first groove 42 and the forward portion 40 and being in communication with the first groove 42, and a pair of holes 418 extending vertically beside the first cavity 44 towards the board mounting surface 416. A slot 420 is formed below sidewall of the first groove 42 for retaining the first grounding terminal 7 therein, as best seen in FIG. 9. A pair of latch portions 422 is formed by the bottom housing 4 beside the first groove 42 and each includes two engaging bars 424 for providing additional engagement of the cable 2 with the bottom housing 4.

The bottom housing 4 further includes a pair of blocks 46 at both lateral surfaces 414 thereby providing engagement between the bottom housing 4 and the upper housing 5 to assure that the upper housing 5 is reliably attached to the bottom housing 4. Each block 46 has a slanted leading surface 460. The bottom housing 4 further includes a pair of posts 48 extending downwardly beyond the board mounting surface 416. Each post 48 includes two legs 480 for engaging in a through hole 32 of the PCB 3 (FIG. 2).

The forward portion 40 has a plurality of recesses 402 divided by pairs of partitions 401, wherein a channel 403 is defined in every pair of the partitions 401. The bottom housing 4 further defines a plurality of passageways 406 in the terminal surface 412, which is in communication with corresponding channels 403 to receiving corresponding grounding terminals 7, 8 therein. The recesses 402 are adopted to receive signal terminals 6 therein. An opening 404 and an aperture 405 are both defined in the forward portion 40 in each recess 402, wherein the aperture 405 extends to reach the board mounting surface 416 and is closer to the terminal surface 412 in comparison with the opening 404.

Figure 5:
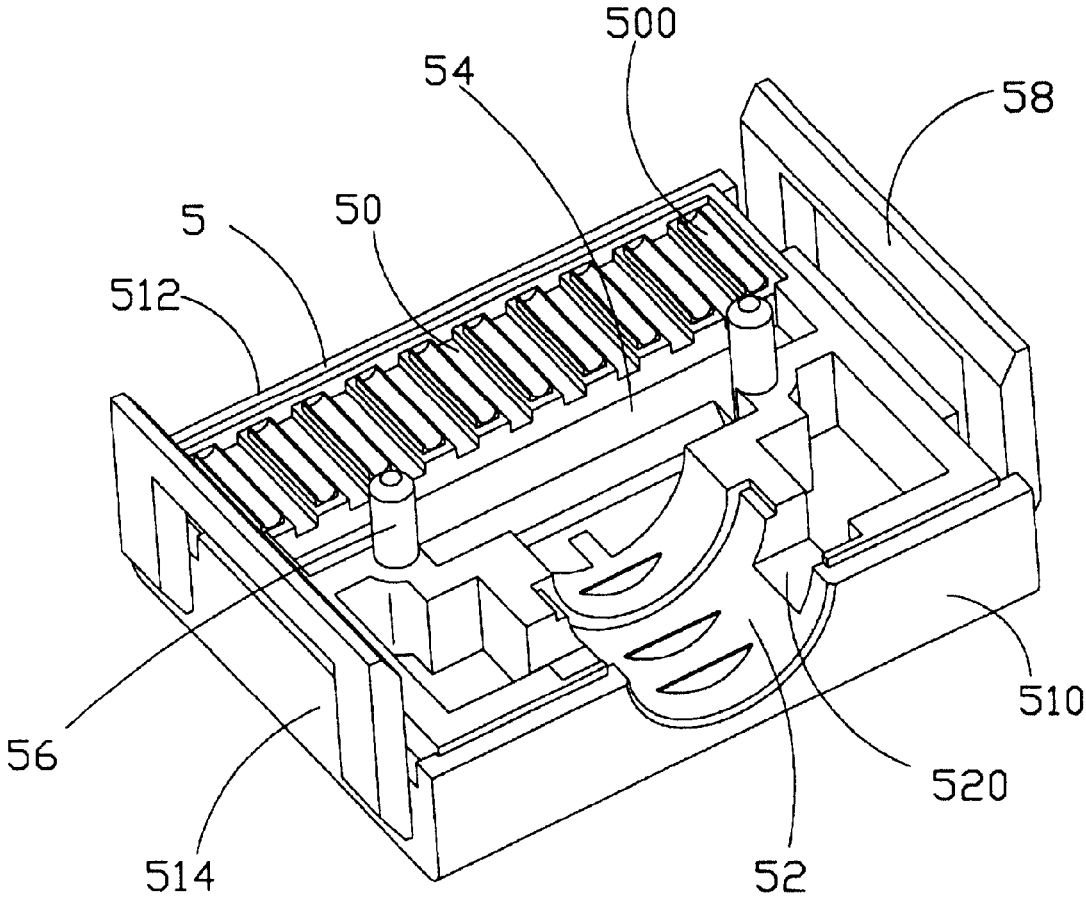
FIG. 5 is a bottom perspective view of an upper housing of the electrical connector.

As can be seen in FIGS. 2 and 5, the upper housing 5 has a cable-receiving surface 510, a terminal surface 512 opposite to the cable-receiving surface 510, a pair of lateral surfaces 514 and an upper surface 516. The upper housing 5 includes a forward portion 50 near the terminal surface 512, a second groove 52 extending inwardly from the cable-receiving surface 510 towards the terminal surface 512, a second cavity 54 defined between the second groove 52 and the forward portion 50 and being in communication with the second groove 52, and a pair of poles 56 respectively extending downwardly beside the second cavity 54. A pair of recesses 520 is defined by the upper housing 5 beside the second groove 52 to cooperate with the latch portions 422 of the bottom housing 4. The upper housing 5 further includes a pair of U-shaped lockers 58 each extending downwardly from a lateral surface 514. The forward portion 50 defines a plurality of parallel depressing blocks 500.

Figure 6:
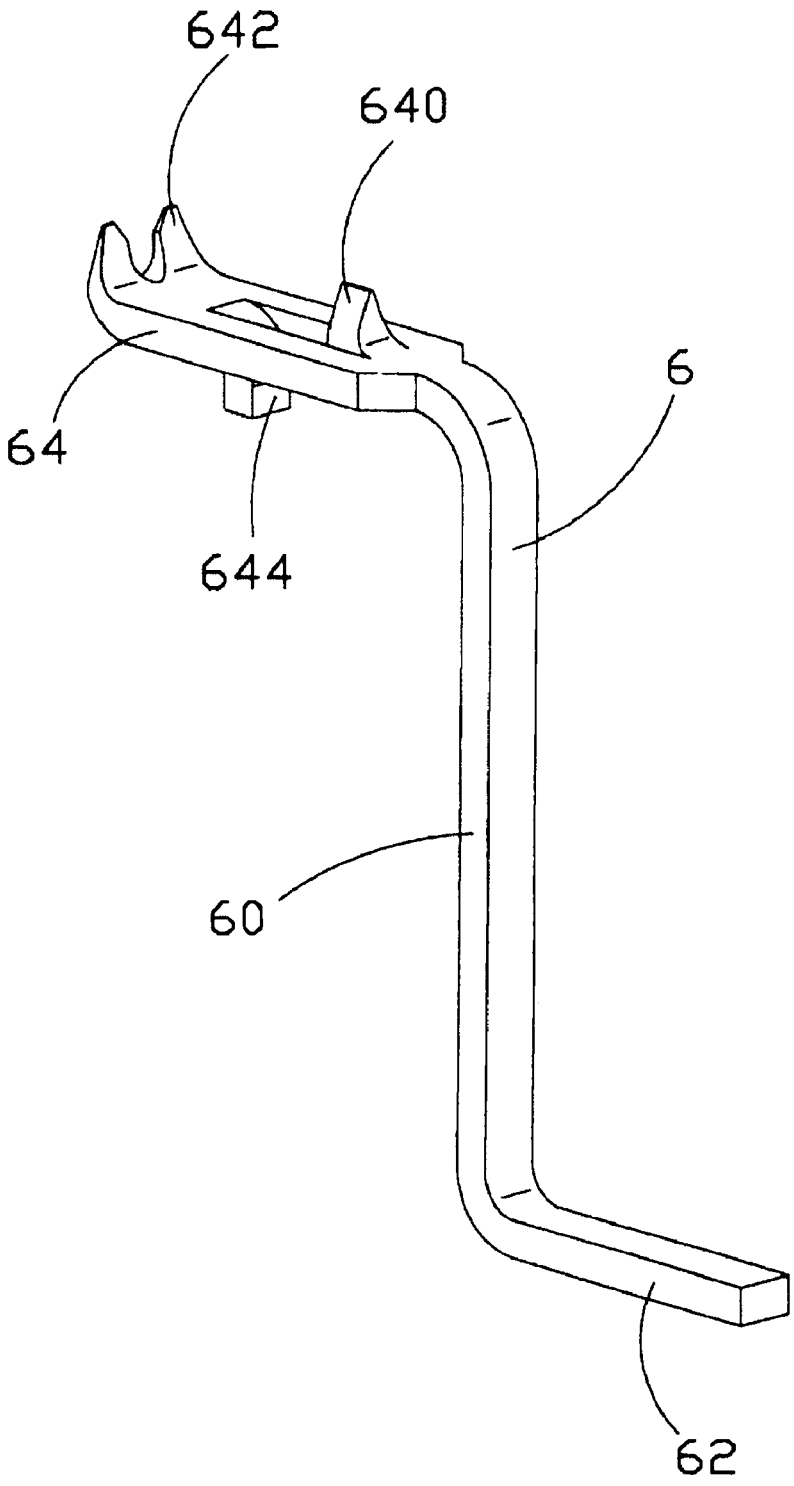
FIG. 6 is a perspective view of a signal terminal of the electrical connector.

Referring to FIG. 6, each signal terminal 6 has a body portion 60, a tail portion 62 for SMT mounting on the PCB 3, and a retention portion 64 projecting forward from the body portion 60. The retention portion 62 further defines a barb 640 extending upwardly from an end thereof adjacent to the body portion 60, a pair of teeth 642 extended upwardly from opposite end thereof, and a protrusion 644 extending downwardly between the barb 640 and the teeth 642. In addition, along a lateral direction, the barb 640 and the protrusion 644 arranged between the pair of teeth 642.

Figure 7:
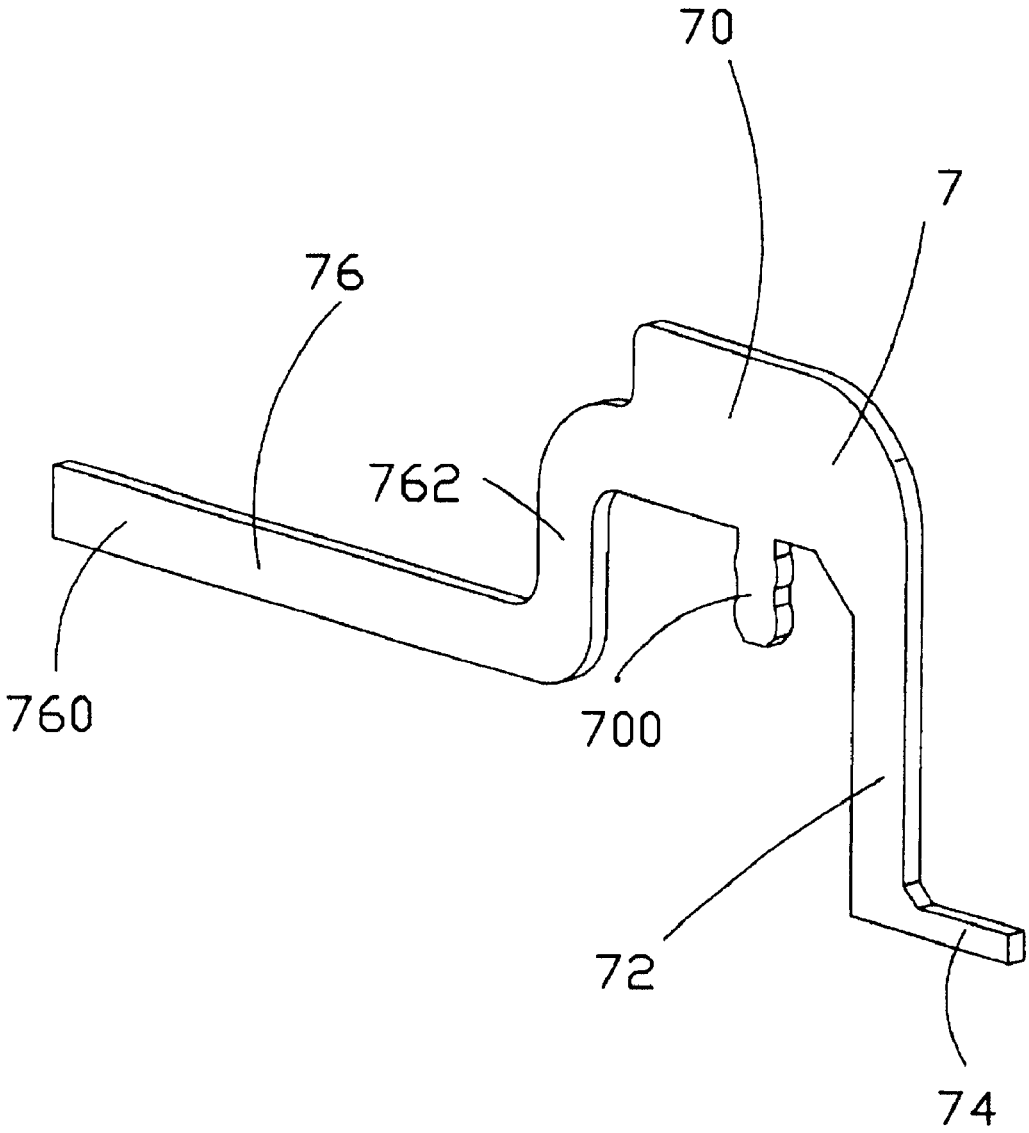
FIG. 7 is a perspective view of a first grounding terminal of the electrical connector.
Figure 8:
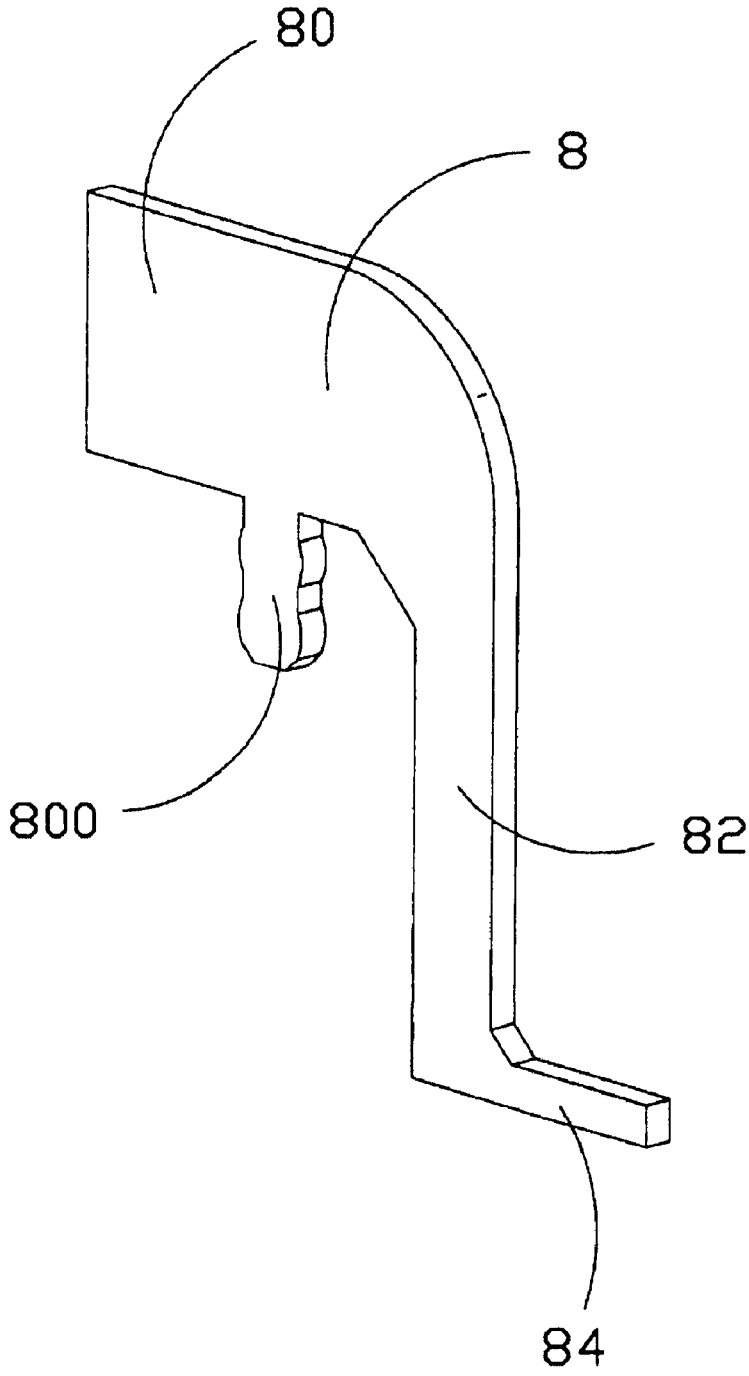
FIG. 8 is a perspective view of a second grounding terminal of the electrical connector.

Referring to FIGS. 7 and 8, the first grounding terminal 7 has a main body 70 with a flat surface, a mounting portion 700 extending downwardly from a bottom side (not labeled) of the main body 70, a limb 76 projecting rearwardly from a bottom side of the main body 70, a retention portion 72 extending downwardly from the main body 70 and a tail portion 74 extending forwardly from a bottom of the retention portion 72 for SMT mounting on the PCB 3 (FIG. 2). Furthermore, the limb 76 defines a vertical portion 762 connecting with the bottom side of the main body 70, and an engaging portion 762 extending horizontally from a lower part of the vertical portion 760. The second grounding terminals 8each have a similar structure with the first grounding terminal 7. Each second grounding terminal 8 has a main body 80 with a flat surface, a mounting portion 800 extending downwardly from a bottom side of the main body 80, a retention portion 82 extending downwardly from the main body 80 and a tail portion 84 extending horizontally from the retention portion 82 for SMT mounting on the PCB 3 (FIG. 2). The second grounding terminals 8 do not have the limb 76 of the first grounding terminal 7.

With reference to FIGS. 1–9, in assembly, the signal terminals 6 are first inserted into the forward portion 40 of the bottom housing 4 so that the retention portions 64 of the signal terminal 6 are located in the recesses 402 with the protrusions 644 being inserted into the openings 404, and the body portions 60 extend through the apertures 405. The first and second grounding terminals 7, 8 are mounted into the forward portion 40 from the terminal surface 412 so that the main bodies 70, 80 of the grounding terminals 7, 8 are retained in respective channels 403 thereby providing additional securing features to hold the grounding terminals 7, 8 in the channels 403. At the same time, the retention portions 72, 82 of the grounding terminals 7, 8 are positioned in the corresponding passageways 406. Furthermore, the limb 76 of the first grounding terminal 7 extends through the first cavity 44 and into the first groove 42 until the engaging portion 760 of the limb 76 is partially located in the slot 420. The flat surface of the main bodies 70, 80 of the first and second grounding terminals 7, 8 provide reliable engagement with the partitions 401 of the forward portion 40. It is noted that the tail portions 62, in this preferred embodiment, extend horizontally at a bottom of the bottom housing 4 after the signal terminals 6 are inserted into the forward portion 40 of the bottom housing 4. Thus the tail portions 62 of the signal terminals 6 can be soldered to the solder pads 30 by SMT.

Upon mounting the electrical connector 1 to the PCB 3, the pair of posts 48 are first aligned with and further partially inserted into the respective through holes 32 of the PCB 3, wherein a portion of each post 48 engages a bottom surface of the PCB 3. The tail portions 62, 74 and 84 of the signal and grounding terminals 6, 7, 8 can be respectively soldered to solder pads 30 of the PCB 3 by SMT.

After the terminals 6, 7, 8 have been secured to the bottom housing 4, the cable 2 is extended into the bottom housing 4 and through the first groove 42 with the shield 22 contacting with the engaging portion 760 of the first grounding terminal 7 for grounding. The wires 20 are extended through the first cavity 44 and further into respective recesses 402, wherein each wire 20 is sandwiched between a corresponding pair of teeth 642 and on a corresponding barb 640.

Consequently, the upper housing 5 is assembled to the bottom housing 4 by aligning the pair of poles 56 and the recesses 520 of the upper housing 5 with the holes 418 and the latch portions 422 of the bottom housing 4, respectively. The lockers 58 touch corresponding leading surfaces 460 of the blocks 46. The upper housing 5 is then pushed towards the bottom housing 5 until the lockers 58 fixedly engage bottom surfaces (not labeled) of the blocks 46, in which the poles 56 are received in the holes 418 and the latch portions 422 are received in the recesses 520. The depressing blocks 500 depress corresponding wires 20 so that the wires 20 are pierced by the teeth 642 and barbs 640 of the signal terminals 6 and conductors (not shown) in the wires 20 are thus electrically engaged with the signal terminals 6. Accordingly, the assembly of the cable 2, the upper and bottom housings 5, 5, the signal and grounding terminals 6, 7, 8 is completed. Thereafter, the electrical connector 1 is assembled to the PCB 3 by inserting the posts 48 into the holes 32, and soldering the tail portions 62, 74, 84 of the terminals 6, 7, 8 to the soldering pads 30.

The present invention provides an electrical connector comprising IDC terminals whereby the electrical connector can connect with a cable in a cost-effective manner. Furthermore, the signal terminals 6 each are located between a pair of grounding terminals; thus, crosstalk of signals under a high speed transmission can be alleviated. Finally, the first grounding terminal 7 has the engaging portion 760 engaging with the shield 22 of the cable 2; thus, the shield 22 of the cable 2 can be effectively grounded to provide an optimal shielding effective to the wires 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounted to a printed circuit board comprising:

a housing having a cable-receiving surface, a terminal surface opposite the cable-receiving surface and a board mounting surface for mounting to said printed circuit board, said housing comprising a cable-receiving groove extending thereinto from the cable-receiving surface, and a plurality of recesses extending thereinto from the terminal surface;

a cable disposed in the housing, the cable having a plurality of wires in the recesses, and a shield surrounding the wires and received in the cable-receiving groove;

a plurality of signal terminals each comprising a retention portion disposed in a corresponding recess of the housing and electrically engaging a corresponding wire by insulation displacement connection (IDC), a body portion engaging with the housing, and a tail portion for soldering to said printed circuit board; and a plurality of grounding terminals received in the housing and arranged alternately to the signal terminals.

2. The electrical connector as described in claim 1, wherein each grounding terminal has a main body with a flat surface to retain the grounding terminal in the housing, a retention portion extending from the main body and approaching the mounting surface of the housing, and a tail portion extending from the retention portion for being surface mounted on the printed circuit board, and a mounting portion is extended downwardly from the main body of each grounding terminal, said mounting portion fitting into the housing.

3. The electrical connector as described in claim 2, wherein at least one grounding terminal defines a limb projecting rearwardly from a bottom side of the main body of the at least one grounding terminal, and the limb includes a vertical portion connecting with the main body and an engaging portion extending from a lower part of the vertical portion, and the shield of the cable engages with the engaging portion of the limb.

4. The electrical connector as described in claim 3, wherein a slot is defined by the housing below the cable-receiving groove to retain the engaging portion of the limb of the at least one grounding terminal therein.

5. The electrical connector as described in claim 1, wherein the retention portion of each signal terminal defines a barb and a pair of teeth respectively extending vertically from opposite ends thereof in a common direction, and the barb is arranged between the pair of teeth.

6. The electrical connector as described in claim 5, wherein the retention portion further defines a protrusion extending opposite to the common direction of the barb and the teeth for being inserted into the housing to locate each signal terminal in the corresponding recess.

7. An electrical connector mounted to a printed circuit board comprising:

a first housing having a first groove and a plurality of recesses communicating with the first groove;

a second housing assembled to the first housing, said second housing having a second groove and a plurality of depressing blocks for being respectively aligned with the first groove and the recesses of the first housing;

a cable extending through a cable-receiving groove defined by the first groove and the second groove, the cable having a plurality of wires extended into the recesses at which the depressing blocks apply pressure to the wires for securing the wires in corresponding recesses;

a plurality of signal terminals each comprising a retention portion disposed in a corresponding recess of the first housing and electrically engaging a corresponding wire by insulation displacement connection (IDC), a body portion engaging with the first housing, and a tail portion for soldering to said printed circuit board; and a plurality of grounding terminals received in the first housing and arranged alternately to the signal terminals.

8. The electrical connector as described in claim 7, wherein the retention portion of each signal terminal defines a barb and a pair of teeth respectively extending vertically from opposite ends thereof in a common direction, and the barb is arranged between the pair of teeth.

9. The electrical connector as described in claim 8, wherein the retention portion further defines a protrusion extending opposite to the common direction of the barb and the teeth for being inserted into the housing to locate each signal terminal in the corresponding recess.

10. The electrical connector as described in claim 9, wherein each grounding terminal has a main body with a flat surface to retain the grounding terminal in the housing, a retention portion extending from the main body and approaching the mounting surface of the housing, and a tail portion extending from the retention portion for being surface mounted on the printed circuit board, and a mounting portion is extended downwardly from the main body of each grounding terminal, said mounting portion fitting into the first housing.

11. The electrical connector as described in claim 10, wherein at least one grounding terminal defines a limb projecting rearwardly from a bottom side of the main body of the at least one grounding terminal, and the limb includes a vertical portion connecting with the main body and an engaging portion extending from a lower part of the vertical portion, and the shield of the cable engages with the engaging portion of the limb.

12. The electrical connector as described in claim 11, wherein a slot is defined by the first housing below the cable-receiving groove to retain the engaging portion of the limb of the at least one grounding terminal therein.

13. The electrical connector as described in claim 7, wherein the first housing further has a pair of latch portions beside the first groove, and each latch portion defines a plurality of engaging bars to engage with the cable.

14. The electrical connector as described in claim 13, wherein the second housing further forms a pair of recesses beside the second groove for cooperating with the latch portions of the first housing.

15. The electrical connector as described in claim 7, wherein the first housing further defines a pair of holes at both sides thereof, and the second housing defines a pair of poles for being inserted into corresponding holes of the first housing.

16. An electrical connector assembly comprising:

a printed circuit board;

an electrical connector mounted on the printed circuit board, said connector including an upper housing and a lower housing fastened to each other;

the lower housing defining a plurality of recesses facing toward the upper housing;

a plurality of signal contacts received in the corresponding recesses, respectively, with at least one upwardly protruding lance, tails of the signal contacts extending out of the lower housing and retainably mounted to the printed circuit board;

the upper housing defining a plurality of pressing blocks facing toward the lower housing and in alignment with the corresponding recesses, respectively, in a vertical direction;

a round cable including a plurality of wires respectively sandwiched between the corresponding signal contacts and the pressing blocks and pierced by the lances of said corresponding signal contacts;

the upper housing and the lower housing further including means for retainable extension of the round cable therethrough; wherein every adjacent two recesses is spaced from each other in a significant distance for allowing an electrical piece to be interposed therebetween.

17. The assembly as described in claim 16, wherein a grounding contact is located between every adjacent two signal contacts.

18. The assembly as described in claim 17, wherein one of said grounding contacts around a center portion of the housing mechanically and electrically engage metallic braiding of the cable.

* * * * *